US011300280B2

(12) United States Patent
Nie et al.

(10) Patent No.: US 11,300,280 B2
(45) Date of Patent: Apr. 12, 2022

(54) LAMP

(71) Applicant: SIGNIFY HOLDING B.V., Eindhoven (NL)

(72) Inventors: Xiao Long Nie, Shanghai (CN); Morna Shen, Shanghai (CN); Qing Zhang, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/294,621

(22) PCT Filed: Nov. 14, 2019

(86) PCT No.: PCT/EP2019/081294

§ 371 (c)(1),
(2) Date: May 17, 2021

(87) PCT Pub. No.: WO2020/099544

PCT Pub. Date: May 22, 2020

(65) Prior Publication Data

US 2021/0356109 A1 Nov. 18, 2021

(30) Foreign Application Priority Data

Nov. 15, 2018 (WO) ..... PCT/CN2018/115727
Feb. 25, 2019 (EP) ..... 19159012

(51) Int. Cl.

| | |
|---|---|
| ***F21V 23/06*** | (2006.01) |
| ***F21K 9/23*** | (2016.01) |
| ***F21V 23/00*** | (2015.01) |
| ***H01R 39/64*** | (2006.01) |
| ***F21Y 115/10*** | (2016.01) |

(52) U.S. Cl.

CPC ..... *F21V 23/06* (2013.01); *F21K 9/23* (2016.08); *F21V 23/007* (2013.01); *H01R 39/64* (2013.01); *F21Y 2115/10* (2016.08)

(58) Field of Classification Search

CPC ..... F21V 23/06; F21V 23/007; F21V 15/01; F21Y 2115/10; F21K 9/23; H01R 39/64; H01J 5/50; H01K 1/46

See application file for complete search history.

(56) References Cited

U.S. PATENT DOCUMENTS 5,921,660 A * 7/1999 Yu ..... F21K 9/232 362/249.03
2010/0267273 A1 10/2010 Henrici et al.
2015/0036361 A1 2/2015 Watanabe et al.
2018/0100642 A1 4/2018 Hall et al.

FOREIGN PATENT DOCUMENTS

DE 202009007781 U1 10/2010
EP 1031164 B1 11/2003
KR 1803269 B1 12/2017

* cited by examiner

*Primary Examiner* — Peggy A Neils
(74) *Attorney, Agent, or Firm* — Daniel J. Piotrowski

(57) ABSTRACT

A lamp has a mechanism for allowing rotational slippage between a lamp body and an electrical connector when an applied torque is too large. This prevents damage during rotational coupling of the lamp, via the electrical connector, to a socket.

13 Claims, 6 Drawing Sheets

Fig. 5

LAMP

CROSS-REFERENCE TO PRIOR APPLICATIONS

This application is the U.S. National Phase application under 35 U.S.C. § 371 of International Application No. PCT/EP2019/081294, filed on Nov. 14, 2019, which claims the benefit of Chinese International Patent Application No. PCT/CN2018/115727, filed on Nov. 15, 2018 and European Patent Application No. 19159012.4, filed on Feb. 25, 2019. These applications are hereby incorporated by reference herein.

FIELD OF THE INVENTION

This invention relates to lamps, and in particular to lamps having an electrical connector which fits to a socket by a coupling which involves rotation of the lamp relative to the socket.

BACKGROUND OF THE INVENTION

When fitting a lamp which has a screw connector to a socket, the action of screwing the connector to the socket will result in a torque between the different parts of the lamp. The torque will depend on the resistance offered by the socket, and will increase as the screw connection becomes tighter. When the screw connection has reached the end of its adjustment range (so that the socket resists all further relative rotation), all torque applied to the lamp will be exerted across components of the lamp.

The lamp screw connector and the lamp body are typically separate components. The screw connector is a metal body whereas the lamp body typically comprises a glass or plastic housing. It can happen that the torque applied by the user may cause a rupture between the screw connector and the lamp body, or result in breaking of the lamp body if it is fragile.

By way of example, the lamp body may be able to sustain a torque of up to 3 Nm. If a larger torque is applied across the lamp, such as 5 Nm, the lamp body may break.

It has been recognized that it would be desirable to prevent damage to a lamp when a large torque is applied. It is known to design the lamp to withstand a larger torque. However, this increases the cost of the lamp.

There remains a need for a lamp which provides protection against breakage in the event of a large torque being applied, but which does not increase significantly the cost of the design.

SUMMARY OF THE INVENTION

The invention is defined by the claims.

According to examples in accordance with an aspect of the invention, there is provided a lamp, comprising:

a lamp body which houses a light source;

an electrical connector for connecting the lamp to a socket by a rotational coupling; and a clutch between the lamp body and the electrical connector for providing rotational coupling or else allowing rotational slippage between the lamp body and the electrical connector, in dependence on a torque applied between the lamp body and the electrical connector.

The clutch releases rotational engagement between the lamp body and the electrical connector in particular when the torque is too high. In this way, damage to the lamp body, or disconnection between the lamp body and the electrical connector, is avoided even if a large torque is applied. This may happen if a user inadvertently over tightens the connection between the lamp and the socket.

The clutch preferably allows rotational slippage only for a torque in one rotational direction.

Thus, the clutch provides protection to prevent over tightening, but still allows the lamp to be disconnected from the socket.

The one rotational direction is for example a clockwise direction of torque applied to the lamp body relative to the electrical connector. This is typically the rotational direction used to fit the lamp to the socket.

The clutch may comprise a first component which forms part of the electrical connector and a second component which forms part of the lamp body. The two components interface with each other to provide a controlled connection between the lamp body and the electrical connector.

The first component for example comprises a first, outer, annular tooth ring and the second component comprises a second, inner, annular tooth ring, wherein the second annular tooth ring is compressible to release engagement between teeth of the first and second annular tooth rings.

The compression takes place when the torque applied reaches a threshold. In particular, the torque is sufficient to overcome the frictional engagement between the teeth, so that the teeth slide relative to each other. This sliding is accompanied by compression of the inner annular tooth ring. For example, if the electrical connection is already tight, the electrical connector of the lamp will resist further rotation, thereby increasing the torque across the clutch. This torque makes the teeth ride over each other in the manner of a ratchet, with the riding accompanied by successive compressions of the inner annular tooth ring.

This provides a low cost ratchet type system. The teeth are preferably shaped so that they can only ride over each other in one direction of relative angular rotation.

The first annular tooth ring may have a continuous ring of teeth and the second annular tooth ring may have toothed regions and non-toothed regions.

The toothed and non-toothed regions are designed to provide a desired amount of total frictional engagement between the teeth, which in turn influences the torque level at which the ratchet function comes into play. Thus, the design of the second annular tooth ring may influence the threshold torque and thereby set the threshold to a level suitable for the particular lamp. The first annular tooth ring, which may form part of the electrical connector, may have a single design so that different lamp bodies can be designed to fit to a standard electrical connector design.

The second annular tooth ring for example comprises a cylinder having the teeth on an outer cylindrical surface and a set of slots extending parallel to the cylinder axis thereby to allow the compression. The slots enable the compression of the second tooth ring in a simple manner.

The second annular tooth ring may comprise a set of hooks for retaining the first annular tooth ring over the second annular tooth ring at a desired axial position. The first annular tooth ring is for example slid over the hooks of the second annular tooth ring, accompanied by compression of the second tooth ring, as part of the assembly. This provides a simple assembly procedure.

The electrical connector may comprise a male screw fitting.

This type of fitting involves a large period of rotational driving, and the user may not be aware when they are applying a torque that could cause damage. The invention may however be applied to other electrical connections which make use of a rotational adjustment, such as bayonet electrical couplings.

For a screw fitting, the electrical connector for example comprises a central conductive pin extending parallel to a connection direction of the electrical connector and forming a first electrical contact, and the lamp body comprises a first brush for making electrical contact with the pin in all rotational positions.

Thus, the angular position of the clutch does not alter the required electrical connection to the central contact of the male screw fitting.

The electrical connector may then comprise a conductive outer wall around the central pin and forming a second electrical contact, and the lamp body comprises a second brush for making electrical contact with an inner surface of the conductive outer wall in all rotational positions.

Thus, the angular position of the clutch does not alter the required electrical connection to the outer thread contact of the male screw fitting.

The lamp body for example houses a lighting driver and the first and second brushes comprise first and second power inputs to the lighting driver. The lighting driver may comprise a circuit board having a tab which projects into the electrical connector and which carries the first and second brushes.

This provides a compact arrangement in which the required electrical connections to allow for the clutch rotation are housed within the volume of the electrical connector.

The light source may comprise a LED or LED array.

The clutch is for example adapted to allow rotational slippage between the lamp body and the electrical connector when the torque applied between the lamp body and the electrical connector exceeds a threshold, wherein the threshold is in the range 2 Nm to 5 Nm.

By preventing torque to reach 5 Nm (or any other desired maximum in the range 2 Nm to 5 Nm) damage to the lamp body, or the connection between the lamp body and the electrical connector, is avoided.

The lamp body may have an outer diameter at least 4 times the outer diameter of the electrical connector. This type of lamp, with a large head, is particularly susceptible to damage because of the large torques that may result during fitting to a socket.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
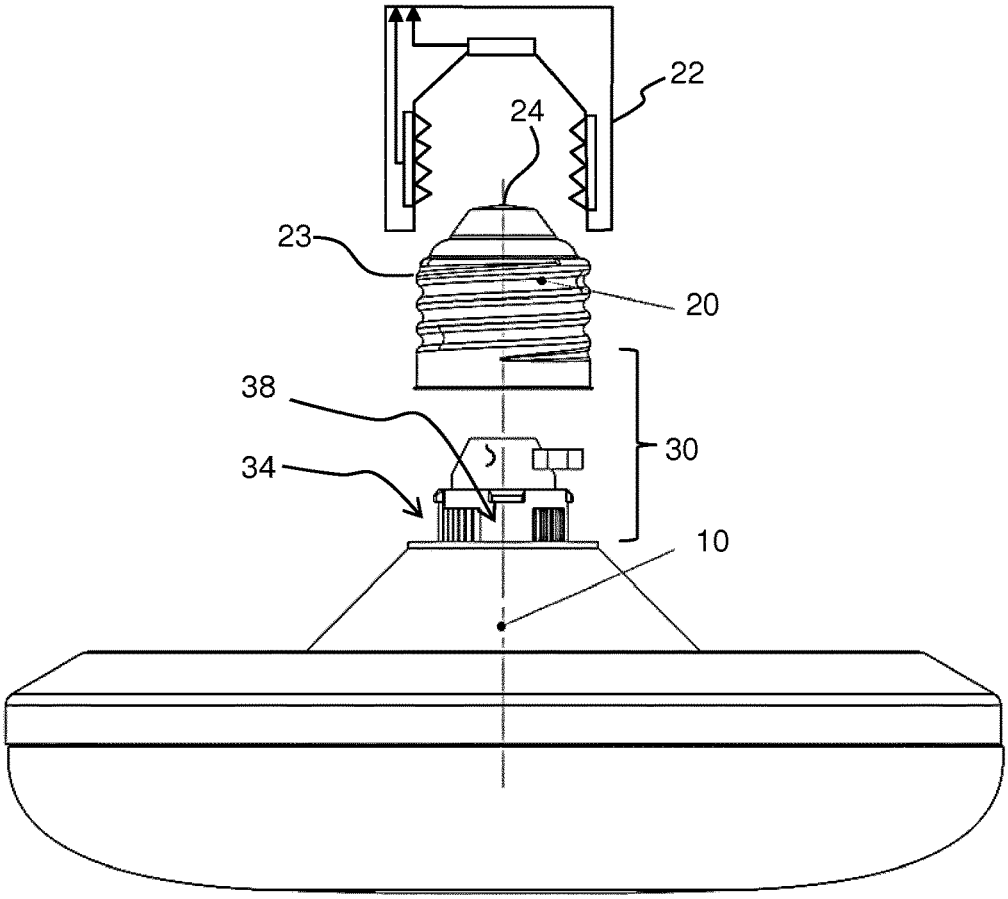
FIG. 1 shows a lamp in a disassembled state.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a lamp having a mechanism for allowing rotational slippage between a lamp body and an electrical connector when an applied torque is too large. This prevents damage during rotational coupling of the lamp, via the electrical connector, to a socket.

FIG. 1 shows a lamp in a disassembled state, comprising a lamp body 10 and an electrical connector 20 for connecting the lamp to a socket 22 by a rotational coupling. The electrical connector is a male screw connector, wherein the screw thread is formed as an outer conductive wall 23, and this outer wall defines a first electrical terminal (i.e. external contact) of the lamp. A central conductive tip 24 forms a second electrical terminal (i.e. external contact) of the lamp.

A clutch 30 is provided between the lamp body 10 and the electrical connector 20 for providing rotational coupling or else allowing rotational slippage between the lamp body and the electrical connector. Slippage is allowed in dependence on a torque applied between the lamp body and the electrical connector.

The clutch 30 releases rotational engagement between the lamp body and the electrical connector in particular when the torque is too high. In this way, damage to the lamp body, or disconnection between the lamp body and the electrical connector, is avoided even if a large torque is applied. This may happen if a user inadvertently over-tightens the connection between the lamp and the socket.

Figure 2:
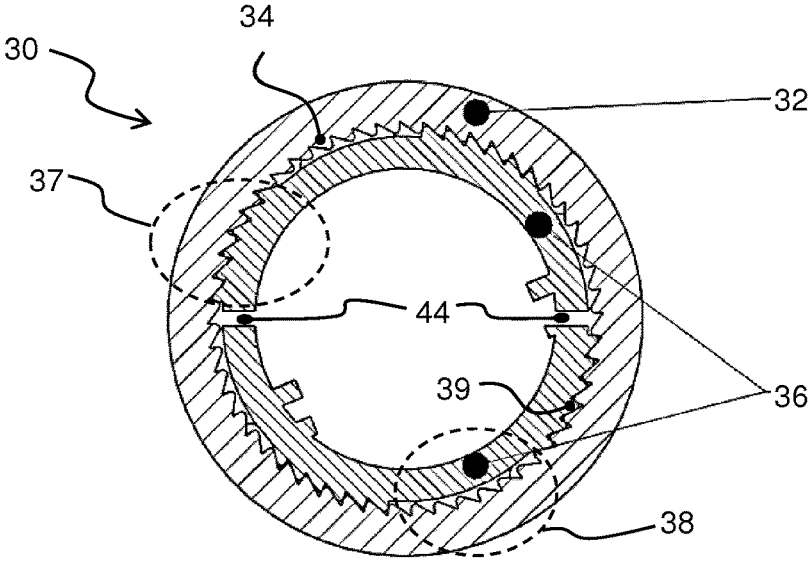
FIG. 2 shows an example of the clutch.

FIG. 2 shows an example of the clutch 30.

A first component 32 forms part of the electrical connector 20. It comprises a first, outer, annular tooth ring having a set of inwardly projecting teeth 34. The teeth 34 form a continuous ring around the inner surface of the first component 32. The teeth 34 are asymmetric. They each have a radial portion and a slope surface which is closer to a circumferential direction. The radial portion is at 80 to 90 degrees to a circumferential direction (so not necessarily perfectly radial), and the slope surface of each tooth is for example at 20 to 60 degrees to the circumferential direction.

The second component 36 comprises a second, inner, annular tooth ring having a set of outwardly projecting teeth 39. The teeth 39 do not need to form a continuous ring. A continuous ring is possible for maximum frictional engagement between the two rings. However, FIG. 2 instead shows that the inner annular ring has toothed regions 37 and non-toothed regions 38.

The teeth 39 are also asymmetric to match the shape of the teeth 34. Thus, they each have a radial portion and a slope surface which is closer to a circumferential direction. The radial portion is again at 80 to 90 degrees to a circumferential direction (so not necessarily perfectly radial), and the slope surface of each tooth is for example at 20 to 60 degrees to the circumferential direction.

When the teeth are engaged with each other, as shown in FIG. 2, the radial portions butt against each other. This means that no matter how much torque is applied (before destruction of the clutch) to the lamp body, and hence to the inner annular ring 36, in the anti-clockwise direction, that torque is applied to the outer annular ring 32. This torque acts to undo the electrical connector from the socket.

The inner annular tooth ring 36 is compressible to release engagement between the teeth 34, 39 of the outer and inner annular tooth rings. The inner annular tooth ring 36 is however biased to the non-compressed state, in which the teeth are engaged.

The sloped portions of the inner and outer annular tooth rings face each other and butt against each other. However, depending on the torque applied to the lamp body, they may slide over each other. A total frictional contact exists between the set of engaged teeth which acts to resist this sliding. In addition, the bias urging the inner annular ring into the non-compressed state also acts to resist this sliding.

When the torque applied overcomes the friction and the bias, in the clockwise direction, the teeth slide relative to each other and inner annular tooth ring compresses. This will happen if a sufficient torque is applied across the clutch.

The clutch then operates as a unidirectional ratchet allowing the lamp body to rotate relative to the electrical connector.

The relative total sizes of the toothed and non-toothed regions are designed to provide a desired amount of total frictional engagement between the teeth, which in turn influences the torque level at which the ratchet function comes into play. Thus, the design of the inner annular tooth ring influences the threshold torque at which slippage is allowed, and thereby sets the threshold to a level suitable for the particular lamp.

The outer annular tooth ring 32 may therefore have a single design so that different lamps can be designed to fit to a standard socket design.

To enable compression of the inner annular ring, it comprises a cylinder having the teeth 39 on the outer cylindrical surface and a set of slots 44 extending parallel to the cylinder axis thereby to allow the compression.

Figure 3:
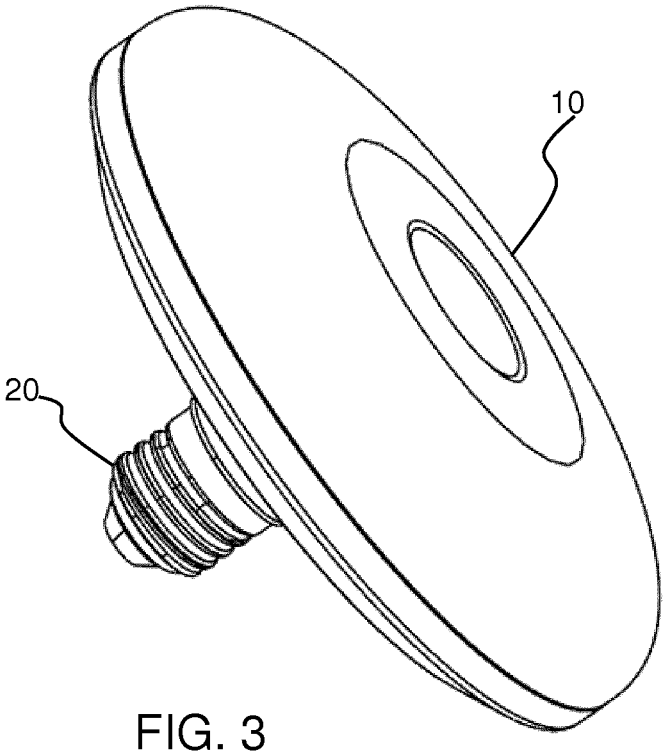
FIG. 3 shows the assembled lamp.

FIG. 3 shows the assembled lamp.

Figure 4:
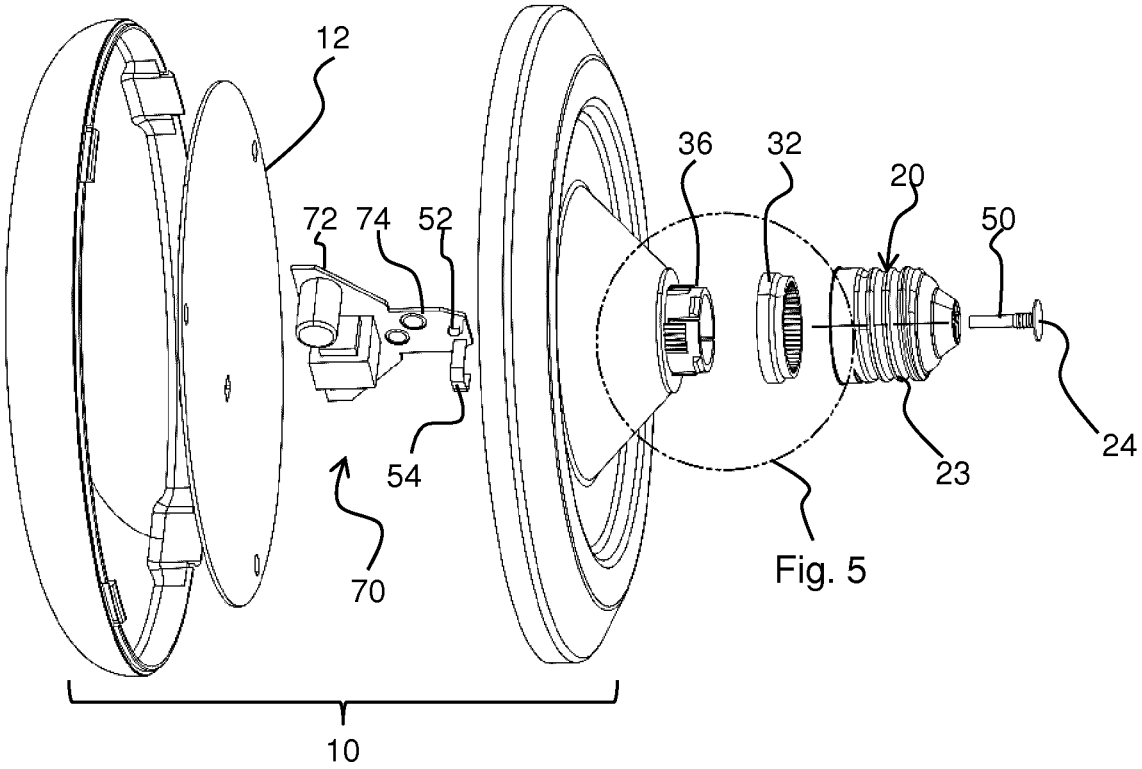
FIG. 4 shows an exploded view of the components of the lamp.

FIG. 4 shows an exploded view of the components of the lamp.

The lamp body 10 houses a light source 12 which for example comprises a circuit board which carries an array of LEDs.

The power for driving the array of LEDs is received from the two terminals 23, 24 of the connector 20. The conductive tip terminal 24 is formed by the end of a pin 50 which extends parallel to a connection direction of the electrical connector.

Because the lamp body 10 can rotate relative to the electrical connector 20, a rotational electrical connection is provided between the lamp body 10 and the two terminals 23, 24 of the electrical connector. For this purpose, there is a first brush 52 for making electrical contact with the pin 50 in all rotational positions and a second brush 54 for making electrical contact with an inner surface of the conductive outer wall 23 in all rotational positions.

The light source is driven by a driver 70. The driver 70 has a circuit board 72 which has a tab 74. The tab 74 carries the first and second brushes 52, 54 and it projects into the internal cavity space of the electrical connector 20 so that the brushes can make contact with the pin 50 and the internal surface of the outer wall 23. The first and second brushes 52, 54 comprise first and second power inputs to the lighting driver 70.

Figure 5:
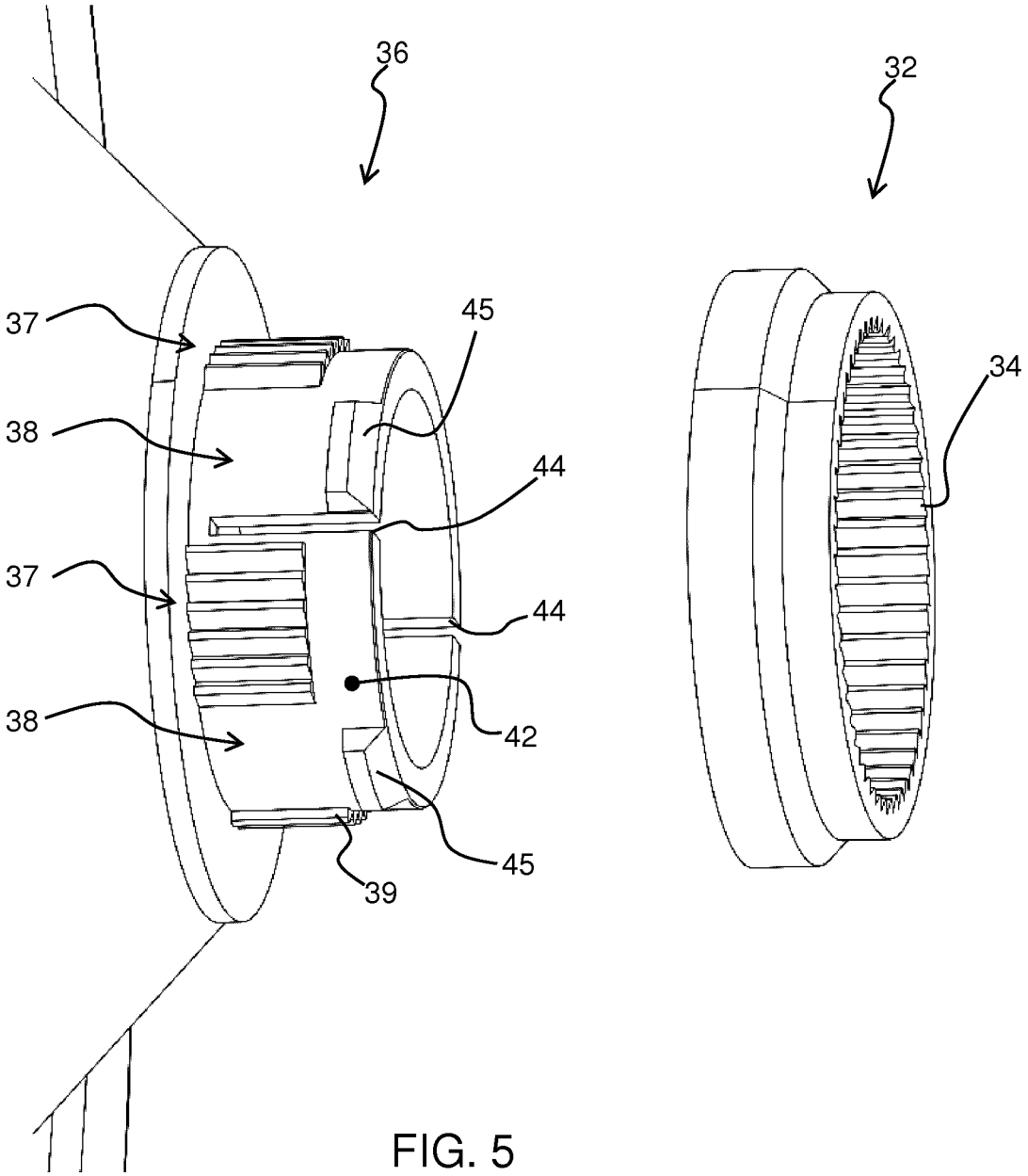
FIG. 5 shows an enlarged view of the outer and inner annular tooth rings.

FIG. 5 shows an enlarged view of the outer and inner annular tooth rings 32, 36.

It shows more clearly how the inner annular tooth ring 36 comprises a cylindrical surface 42 with axial slots 44. In this example, there are two slots, so that two halves of the ring may contract together to reduce the effective diameter of the ring, and hence allow the teeth to ride over each other. In this example, there are four toothed areas 37 and four non-toothed areas 38. However, the total number of teeth of the second annular ring defines the total frictional engagement, and the toothed and non-toothed areas may be arranged in any manner, for example simply with each tooth spaced from the adjacent teeth on each side, giving a uniform distribution of teeth instead of the clustered distribution shown.

The inner annular tooth ring 36 is designed (taking into account the design of the outer annular tooth ring) such that the clutch allows rotational slippage between the lamp body and the electrical connector when the torque applied between the lamp body and the electrical connector exceeds a threshold. The threshold is set at a level such that the lamp can be sufficiently tightly fitted to the socket but cannot be overtightened to cause damage. The threshold is for example in the range 2 Nm to 5 Nm.

The inner annular tooth ring 36 has a set of hooks 45 disposed around the end of the cylindrical surface 42. These hooks engage with the outer annular tooth ring 32 to maintain the outer annular tooth ring in the correct axial position (i.e. with the teeth of the two annular tooth rings aligned axially with each other) after assembly. The hooks 45 have a ramp surface over which the outer annular tooth ring 32 can be pushed during assembly. The inner annular tooth ring compresses to allow the outer annular tooth ring to ride over the hooks during assembly, and the outer annular tooth ring is then axially held in place. There may for example be a set of 2 to 4 of the hooks 45 disposed around the circumference of the end of the cylindrical surface 42.

The outer surface of the outer annular tooth ring 32 may be a frictional fit into the opening of the cap forming the electrical connector 20, and optionally it may also be bonded to the cap. Thus, the assembly may comprise assembling the clutch by fitting the outer annular tooth ring over the inner annular tooth ring, and then fitting the clutch to the cap which forms the male electrical connector. Alternatively, the outer annular tooth ring may be assembled to the cap first, and then the cap and the outer annular tooth ring 32 may be assembled as a unit over the inner annular tooth ring. In both cases, the resulting assembly of the electrical connector to the lamp body may be a push fit.

Figure 6:
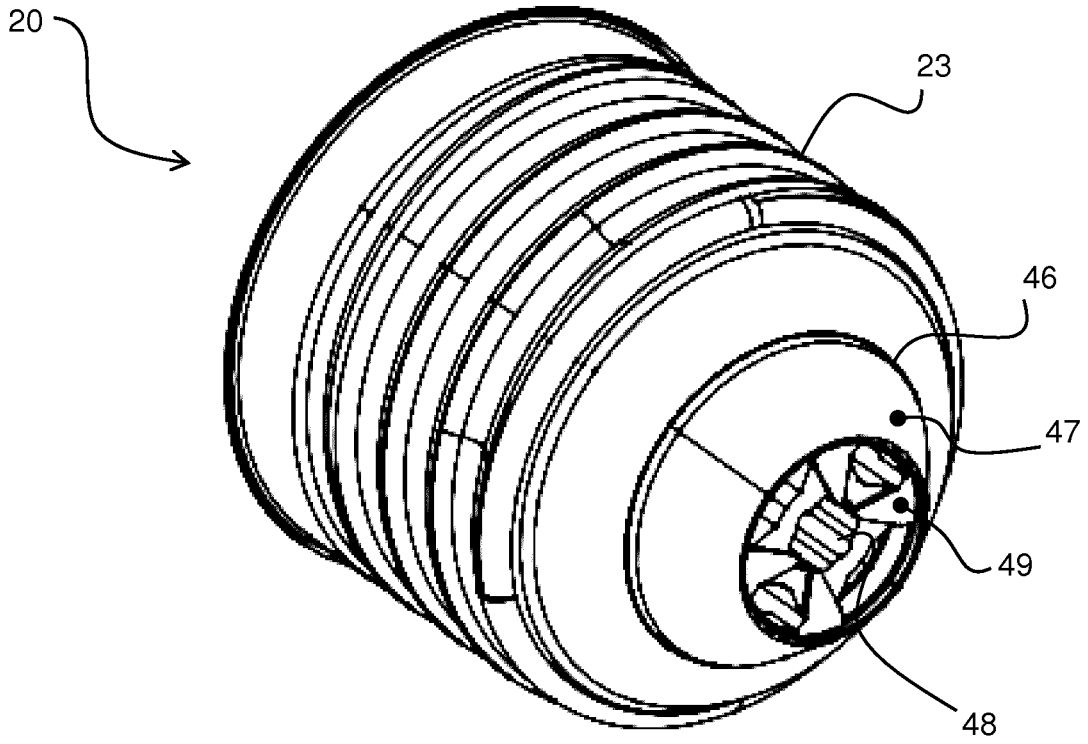
FIG. 6 shows the male screw fitting of the electrical connector in perspective view, showing the outer surface.

FIG. 6 shows the electrical connector 20 in perspective view, showing the outer surface. The electrical connector 20 comprises a hollow cap which defines the conductive outer wall 23, with an opening 46 at the end. A plastic insert 47 is fitted to the opening 46 and defines an inner opening 48 for receiving the pin 50 (shown in FIG. 4). The plastic insert 47 thus provides electrical insulation between the outer wall 23 (which defines one terminal) and the pin (which defines the other terminal). The insert 47 has a set of radial supporting ribs 49 which support a ring which defines the inner opening 48.

Figure 7:
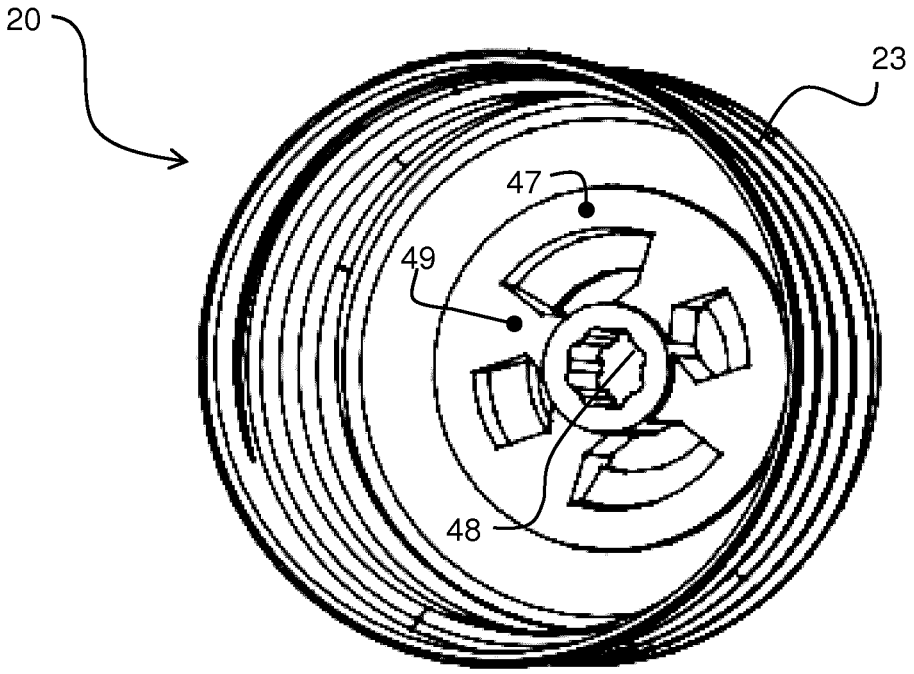
FIG. 7 shows the male screw fitting of the electrical connector in perspective view, showing the inner surface.

FIG. 7 shows the electrical connector in perspective view, showing the inside of the cap, looking towards the tip where the insert 47 is located.

Figure 8:
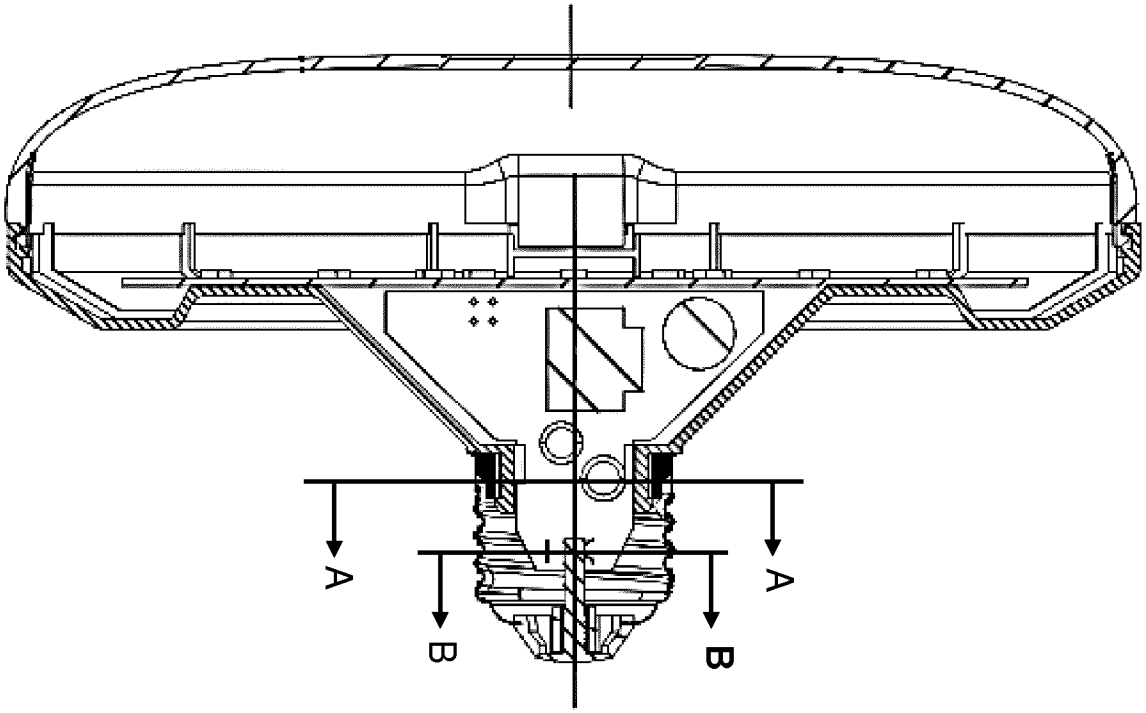
FIG. 8 shows the assembled lamp in cross section.

FIG. 8 shows the assembled lamp in cross section.

Figure 9:
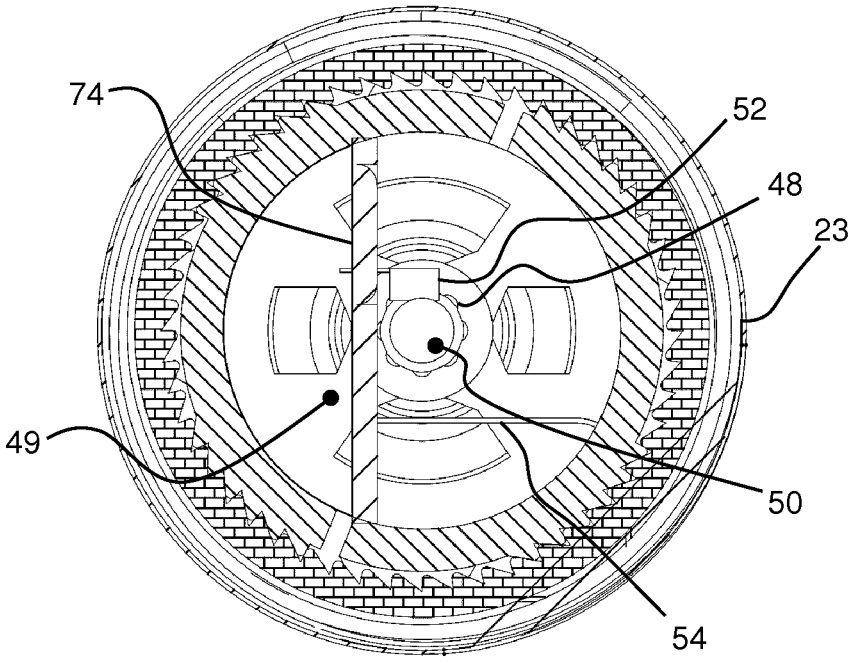
FIG. 9 shows the A-A section view as shown in FIG. 8.

FIG. 9 shows one cross section identified in FIG. 8 as A-A. It is a cross section through the clutch and through the tab 74 of the driver circuit board, at the lamp body side of the brushes 52, 54. The cross section is taken looking towards the tip of the electrical connector. Thus, the brushes 52, 54 are visible in the background as well as the insert at the tip of the electrical connector. The radial supporting ribs 49 and the opening 48 are labeled.

Figure 10:
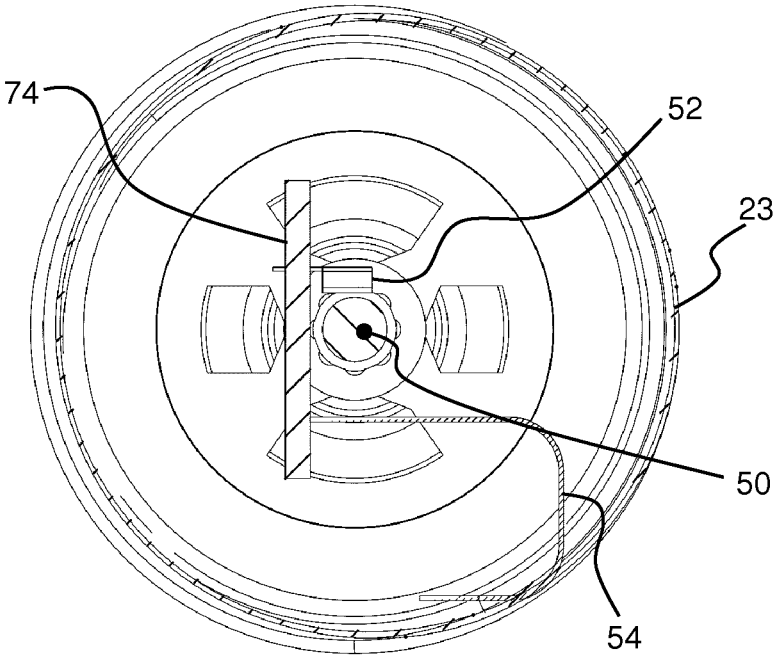
FIG. 10 shows the B-B section view as shown in FIG. 8.

FIG. 10 shows another cross section identified in FIG. 8 as B-B. It is a cross section through the tab 74 of the driver circuit board, further into the electrical connector 20 than the clutch, and through the brushes 52, 54. Thus, the brushes 52, 54 are visible in cross section.

The design of the invention is of particular interest for lamps in which the lamp body 10 has an outer diameter at least 4 times the outer diameter of the electrical connector 20, as can be seen in FIG. 1 for example. This type of lamp, with a large head, is particularly susceptible to damage because of the large torques that may result during fitting to a socket.

The invention is described above in connection with a screw type electrical connector. This type of fitting involves a large period of rotational driving. The invention may however be applied to other electrical connections which make use of a rotational adjustment, such as bayonet electrical couplings or any other twist and lock electrical connector.

The example above makes use of a ratchet. This means that the slippage only takes place in one direction. A ratchet tooth design is not essential. The slippage may only be a sliding movement (instead of a ratchet movement). The slippage may be allowed by releasing a brake, and this brake may be released by applying a sufficient torque in one direction only. Thus, other types of clutch are possible.

The compression of the inner annular tooth ring does not need to base on closing of slots. An alternative is for the material itself to have some flexibility so that compression of the whole body takes place at the desired torque level. The slots may instead be defined by regions of greater compressibility or flexibility rather than completely removed regions.

The example above makes use of an outer annular tooth ring for the lamp body 10 and an inner annular tooth ring for the connector 20. The opposite arrangement is of course possible.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A lamp, comprising:

a lamp body which houses a light source;

an electrical connector for connecting the lamp to a socket by a rotational coupling; and a clutch between the lamp body and the electrical connector for providing rotational coupling or else allowing rotational slippage between the lamp body and the electrical connector, in dependence on a torque applied between the lamp body and the electrical connector; the clutch comprises a first component which forms part of the electrical connector and a second component which forms part of the lamp body;

wherein the first component comprises a first, outer, annular tooth ring and the second component comprises a second, inner, annular tooth ring, wherein the second annular tooth ring is compressible to release engagement between teeth of the first and second annular tooth rings.

2. A lamp as claimed in claim 1, wherein the clutch allows rotational slippage only for a torque in one rotational direction.

3. A lamp as claimed in claim 2, wherein the one rotational direction is a clockwise direction of torque applied to the lamp body relative to the electrical connector.

4. A lamp as claimed in claim 1, wherein the first annular tooth ring has a continuous ring of teeth and the second annular tooth ring has toothed regions and non-toothed regions.

5. A lamp as claimed in claim 1, wherein the second annular tooth ring comprises a cylinder having the teeth on an outer cylindrical surface and a set of slots extending parallel to the cylinder axis thereby to allow the compression.

6. A lamp as claimed in claim 5, wherein the second annular tooth ring comprises a set of hooks for retaining the first annular tooth ring over the second annular tooth ring at a desired axial position.

7. A lamp as claimed in claim 1, wherein the electrical connector comprises a male screw fitting comprising a central conductive pin extending parallel to a connection direction of the electrical connector and forming a first electrical contact, and wherein the lamp body comprises a first brush for making electrical contact with the pin in all rotational positions.

8. A lamp as claimed in claim 7, wherein the electrical connector comprises a conductive outer wall around the central pin and forming a second electrical contact, and wherein the lamp body comprises a second brush for making electrical contact with an inner surface of the conductive outer wall in all rotational positions.

9. A lamp as claimed in claim 8, wherein the lamp body houses a lighting driver, wherein the first and second brushes comprise first and second power inputs to the lighting driver.

10. A lamp as claimed in claim 9, wherein the lighting driver comprises a circuit board having a tab which projects into the electrical connector and which carries the first and second brushes.

11. A lamp as claimed in claim 1, wherein the light source comprises a LED or LED array.

12. A lamp as claimed in claim 1, wherein the clutch is adapted to allow rotational slippage between the lamp body and the electrical connector when the torque applied between the lamp body and the electrical connector exceeds a threshold, wherein the threshold is in the range 2 Nm to 5 Nm.

13. A lamp as claimed in claim 1, wherein the lamp body has an outer diameter at least 4 times the outer diameter of the electrical connector.

* * * * *